US005541716A

United States Patent [19]

Schmidlin

[11] Patent Number: 5,541,716

[45] Date of Patent: Jul. 30, 1996

[54] ELECTROSTATIC TONER CONDITIONING AND TRANSPORT SYSTEM

[76] Inventor: Fred W. Schmidlin, 8 Forestwood La., Pittsford, N.Y. 14534

[21] Appl. No.: 494,687

[22] Filed: Jun. 26, 1995

[51] Int. Cl.[6] ..... G03G 15/08

[52] U.S. Cl. ..... 355/261; 355/262; 355/245; 118/653

[58] Field of Search ..... 355/261, 262, 355/298, 245; 347/112; 118/653

[56] References Cited

U.S. PATENT DOCUMENTS 4,423,950 1/1984 Sagami .
4,875,081 10/1989 Goffe ..... 355/303
4,896,174 1/1990 Stearns .

*Primary Examiner*—R. L. Moses
*Attorney, Agent, or Firm*—Robert J. Bird

[57] ABSTRACT

A transport system for charging and delivering right-sign electrostatic toner to an image receiving member includes a toner conveyor having a loading/filtering segment and a delivery, segment. Each segment has a number of parallel electrodes connected to a DC-biased multiphase electric power to establish a traveling electrostatic wave to move toner along the segment. The loading/filtering segment gathers toner from a supply and feeds unipolar toner to the delivery segment. The delivery segment delivers right sign toner to the image receiving member. The traveling wave in the loading/filtering segment moves toner in either a synchronous surfing mode or an asynchronous hunching mode to the delivery segment. The traveling wave in the delivery segment moves toner in an asynchronous hunching mode to the image receiving member. The traveling wave and the speed of toner movement in the loading/filtering segment and the delivery segment are subject to control by means of the bias, amplitude, and frequency of the electric power on the respective segments. First and second toner extractors adjacent to the conveyor are electrically biased to extract therefrom, respectively, wrong-sign toner before it reaches the image receiving member, and unused right-sign toner after it passes the image receiving member.

21 Claims, 10 Drawing Sheets

ELECTROSTATIC TONER CONDITIONING AND TRANSPORT SYSTEM

BACKGROUND OF THE INVENTION

This invention relates to electrostatic printing devices and more particularly to a toner delivery system for presenting toner to a charge retentive surface or to an electronically addressable printhead utilized for depositing toner in image configuration on receiver substrates.

Of the various electrostatic printing techniques, the most familiar and widely used is xerography in which a latent electrostatic image is formed on a charge retentive surface, developed by a suitable toner material to render the image visible, and the developed image is transferred to plain paper.

Another form of electrostatic printing is one known as direct electrostatic printing (DEP), in which, unlike xerography, toner is deposited directly or "written" onto a receiving surface or substrate in image configuration. This type of printing device is disclosed in U.S. Pat. No. 3,689,935 issued Sep. 5, 1972 to Gerald L. Pressman et al.

Pressman et al. disclose an electrostatic line printer incorporating a multi-layered particle modulator or printhead including a dielectric layer sandwiched between a continuous conductive layer on one side and a segmented conductive layer on the other side. The particle modulator further includes one or more rows of apertures. Each segment of the segmented conductive layer is formed around a portion of an aperture, and is electrically isolated from every other segment of the segmented conductive layer. Selected potentials are applied to each of the segments, while a fixed potential is applied to the continuous conductive layer. An overall applied field projects airborne charged particles through the apertures of the particle modulator, and the density of the particle stream is modulated according to the pattern of potentials applied to the segments of the segmented conductive layer. The modulated stream of charged particles is intercepted by a print-receiving medium to provide line-by-line scan printing. In the Pressman et al. device, toner is supplied to the control member by a uniform field which results in toner accumulations on the printhead. This disturbs the toner flow and produces irregularities in the printed image. The openings in the printhead are subject to clogging, and high speed recording is difficult.

U.S. Pat. No. 4,568,955 issued Feb. 4, 1986 to Hosoya et al. discloses apparatus to record visible images on plain paper by a developer. It includes a toner bearing developing roller spaced from and facing the plain paper. A recording electrode responsive to a signal source generates an electric field between the plain paper and developing roller, in accordance with image information, to propel toner from the developing roller to the plain paper. Mutually insulated electrodes, extending in one direction on the developer roller, are connected to A.C. and D.C. sources to produce an alternating electric field between successive electrodes and to liberate toner from the developer roll. Hosoya et al. further disclose an open-top toner reservoir below a recording electrode. A toner carrying plate in the reservoir is driven by a three phase generator to agitate the toner and produce a traveling wave that allegedly transports toner in the form of a "smoke" from the toner reservoir to the recording electrode. The use of a single traveling wave device, however, to perform all tasks (namely, charging, transport and delivery to a recording electrode) is unsuitable for recording high quality images at recording speeds of practical interest.

Hosoya also does not show how to operate the traveling wave device to deliver unipolar toner, or to achieve toner motions suitable for the printing of quality images.

U.S. Pat. No. 4,814,796 issued Mar. 21, 1989 to Fred W. Schmidlin discloses a direct electrostatic printing (DEP) apparatus including a toner delivers' system in which a donor roller presents charged toner to an apertured printhead, toner being deposited on the donor roller via a magnetic brush. The donor roller is positioned adjacent to the printhead structure to form a nip area therebetween. The toner on the donor roller is excited into a cloud-like state in the nip area via an A. C. voltage applied between the donor roller and the shield electrode of the apertured printhead. In operation of the DEP apparatus, toner particles that are predominantly charged to one polarity, referred to as "right sign toner" (or RST), are passed through apertures and deposited on the receiver substrate, such as plain paper. The control electrodes which propel toner through the apertures, and an opposed paper shoe, are at voltages opposite in polarity to the charge on the RST. The voltage of the paper shoe is much greater than the voltage on the control electrodes so the RST are attracted to the paper shoe and not to the control electrodes. To prevent the passage of toner through a given aperture, its control electrode is switched to a large voltage of the same polarity as the RST. This repels the RST and forces them back toward the donor. In this circumstance no toner is deposited on the paper. The control electrode is then said to be in the OFF state.

In the OFF state, any toner in the toner cloud near the aperture which is opposite in polarity to the right sign toner, referred to as wrong sign toner (WST), will be drawn through the aperture and collected on the control electrode. The WST does not deposit on the paper because the paper shoe is the same polarity as the WST and therefore repels WST from the paper. Thus, collection of WST on the control electrode does not immediately affect image quality. It becomes a problem when an aperture is in the OFF condition for an extended duration, as needed to print large white areas. In that event, relatively large amounts of WST accumulate on the control electrodes and the electrostatic charge associated with such accumulations produces an electric field that counters the working field produced by the control voltage. Eventually, this counter field negates enough of the control field to enable right sign toner to leak through the aperture. This toner then lands on the paper, where it produces a noticeable, unwanted, gray background.

The foregoing discussion explains the fundamental reason why DEP requires the use of a magnetic brush containing a very low concentration of WST. With sufficiently low concentrations of WST in the toner supply it is possible to maintain a control electrode in the OFF state for a full page length without producing an unacceptable level of gray background. The printhead can then be restored to a clean state between pages using a cleaning process such as described in U.S. Pat. No. 4,755,837 issued Jul. 5, 1988 to Fred W. Schmidlin et al.

By way of example, a DEP apparatus designed to work with negative toner may utilize a paper shoe set to +400 volts and control electrodes biased to +50 Volts in the ON state, and −350 volts in the OFF state. In this case, the positive WST will be repelled from the paper shoe and attracted to the negative control electrode in the OFF state. With these operating voltages it is known that an 11 inch length of white, with no noticeable background, can be printed if the quantity of WST that flows to the control electrodes in the OFF state is less than 0.2% of the RST that flows to the paper in the ON state.

Another from of DEP apparatus conceived to deliver a minimum of WST to a DEP printhead is described in U.S. Pat. No. 4,743,926 issued May 10, 1988 to Fred W. Schmidlin. The toner delivery process described in that patent is based on a traveling wave toner transporting device known as a Charged Toner Conveyor (CTC). The CTC, described in detail in U.S. Pat No. 4,647,179 issued May 3, 1987 to Fred W. Schmidlin is well suited for effecting spatial separation of toner of opposite polarity while in transport on the conveyor, making it possible to extract toner of one polarity from the conveyor while leaving toner of the other polarity on the conveyor for transport to a point of use. U.S. Pat. No. 4,743,926 describes one means of extracting WST from a CTC prior to delivery to a DEP printhead. It uses a second CTC placed in face-to-face relation with the primary CTC and an electrical bias to attract WST from the primary CTC to the second CTC. The primary CTC then transports the right sign toner past the DEP printhead where it is used for printing.

Invention of the CTC was based on the idea that toner can be carried on a traveling wave in a manner analogous to the way a surfer rides water waves. Because of this analogy, the toner motion achieved on the CTC is called the "surfing mode". By analysis, it was established that at sufficiently low frequencies the toner moves synchronously with a wave while it is constantly pushed toward the conveyor surface by a normal force (perpendicular to the surface) provided by the wave itself. The toner particles move at the speed of the wave while seeking out a stable phase relation established by the average frictional drag. But in practice, the toner particles are frequently scattered off the conveyor surface by irregularities in the shape of the conveyor surface, or the shape of the toner. The scattered toner are continually returned to the conveyor surface by the normal force of the wave, producing a local toner cloud that moves synchronously with the wave. The most important aspect of this surfing mode is that toner of a given polarity ride the wave in a restricted phase range, while toner of the opposite polarity ride the wave with this phase range shifted by 180 degrees. This occurs because the wave appears inverted to a negative toner compared to the way it appears to a positive toner. The fact that the toner move spatially separated (by a half wave length) in the surfing mode makes it possible to remove one of the polarities from the conveyor with a normal force, and thereby achieve toner charge filtering. Such is the basis of my U.S. Pat. No. 4,743,926.

Another form of traveling wave toner transport device, known as an "Electric Curtain" (EC), was invented by Masuda (cf. U.S. Pat. No. 3,872,361: No. 3,778,678 and No. 3,801,869). The toner motion produced by this device, retorted to as the "curtain mode", is asynchronous, with the toner moving much slower than the wave. In the curtain mode the toner execute cycloidal like orbits (shown later), while being repelled from the conveyor surface via a force derived from the time average of the field gradient of the traveling wave in interaction with the oscillatory motion of the toner. This force is dependent on the toner moving much slower than the wave. Application of the Electric Curtain as a development means, as tacitly suggested by the aforementioned Hosoya et al., U.S. Pat. No. 4,568,955, has been frequently proposed, but not in conjunction with a toner conditioning means. Transport of toner in the curtain mode is also unsuitable for imaging applications because the toner speed is too slow to be of practical value.

I have discovered a new mode of traveling wave toner transport, which forms the basis for the present invention. This new mode is readily distinguishable from both the surfing mode and the curtain mode. It is produced by applying a uniform electric field ($E_b$) normal to a traveling wave conveyor while operating the conveyor at a frequency sufficient to otherwise produce the curtain mode. The bias field is sufficiently large to force toner into contact with the conveyor surface, over powering the repulsive force of the wave that sustains the normal curtain mode. The toner moves slower than the wave, with periodic surges as each wave overtakes and passes through the toner. In effect, the toner attempts to catch each wave but fails because the frequency and speed of the wave is too great. Thus each wave "hunches" (lifts and thrusts forward) the toner in the direction of the wave. The motion (illustrated later) is clearly distinguishable from the surfing and curtain modes, and is referred to as the "hunching" mode. The discovery of this mode is important because the average speed of the toner can be controlled in a range that is ideally suited tier imaging applications. The average toner speed can be specifically tuned for each application via the combination of wave frequency and the strength of the bias field. Toner speeds best suited for practical imaging applications are much greater than can be achieved with the curtain mode. The desired speed range can be achieved via the surfing mode but at a lower than desired mass transport rate. Thus the hunching mode is of great practical importance, for it is the only mode capable of delivering high quantities of toner to a latent image at the optimal speed.

I discovered the hunching mode through extensive analysis of toner motions produced by traveling waves. The analytical formalism used for this investigation is described in a paper entitled "The Modes of Traveling Wave Particle Transport and their Applications" by F. Schmidlin, published in the Journal of Electrostatics, Vol. 34, 1995. This publication focuses on the previously known surfing and curtain modes. I discovered the hunching mode only recently while investigating the effect of a bias field to find a mode of toner motion more suitable for imaging applications. The discovery of the hunching mode formed the basis for the traveling wave toner conveyor systems of the present invention.

The method of design is best illustrated by examples. There are three dimensionless parameters of importance in this analysis:

1) a reduced frequency parameter, $\Omega=f\lambda/(bE_o)$, where f is the frequency of the multiphase generator driving the conveyor, $\lambda$ is the wavelength of the traveling wave, $E_o$ is the amplitude of the electric field of the traveling wave, $b=Q/6\pi\eta a$ is the drift mobility of a toner having charge Q and radius a, and $\eta$ is the coefficient of viscosity of a particle moving in still air;
2) a reduced mass parameter, $M=2\pi bE_o\tau/\lambda$, where $\pi=bm/Q$ is the viscous relaxation time for a particle of mass m; and
3) a pseudo gravity parameter, $G=E_b/E_o$, where $E_b$ is the magnitude of a uniform d.c. bias field normal to the surface of the conveyor.

In previous work, the parameter G was determined by gravity, and was important only in the curtain mode of a horizontal conveyor. For the new hunching mode of this invention, gravity is negligible (as it is for the surfing mode) and G is uniquely determined by the normal bias field $E_b$ in units of $E_o$. This force, by construction, is always directed normal to the conveyor for any orientation of the conveyor.

All possible toner motions of interest are determined by the three parameters: $\Omega$, M and G. The physical quantities which determine these parameters are given by their foregoing definitions. It should be noted that M in particular is determined by the conveyor wave-length ($\lambda$), the field-amplitude ($E_o$) of the wave, the toner charge/mass ratio (Q/m) and toner radius a. Representative values for these physical quantities are $E_o$=3.4 volts/μm; λ=4 mm; Q/m≅8 μC/gm; and a≅5 μm, leading to M≅40. Other choices for these parameters for imaging applications typically lead to values of M in the range between 5 and 100. Given M, the possible single particle toner motions become determined by Ω and G. These are respectively controlled by the physical operating parameters of frequency (f) and bias field ($E_b$).

Prior traveling wave studies focused on a pure gravitational bias, G≅0.01, for which the possible modes of transport are the surfing mode for $\Omega<\Omega_c\cong 1.7/\sqrt{M}\cong 0.3$ (for M=40), and the curtain mode for $\Omega>\Omega_c$. The frequency $\Omega_c$ is the critical frequency above which the synchronous surfing mode is not possible. Characteristically, toner move at the wave speed (fλ) in the surfing mode; and at a very low speed in the curtain mode—much too slow to be of practical interest in imaging applications. Representative toner trajectories for the surfing and curtain modes are shown in FIG. 8. The dimensionless coordinates (X,Z) in this figure correspond to the actual coordinates in units of λ/(2π). The dimensionless average toner speed in the X-direction is denoted <U> and corresponds to the actual speed in units of bEo/√M. FIG. 8 a shows toner catching the wave after one hop, after which the toner moves at the wave speed of 1.34, or 5 m/sec for M=5. Increasing the frequency to 0.63 causes the toner to launch into the curtain mode as shown in FIG. 8*b*, whence the toner slows to an average speed of<U>= 0.0066, or 0.02 m/sec. As shown in FIG. 8*c*, increasing the frequency to Ω=1, causes the toner to move somewhat closer to the conveyor surface (at Z=0) at the even slower speed of <U>=0.0041. A graph of the average speed, <U>, vs. frequency, Ω, for M=5 is shown In FIG. 9. Note the sharp drop in speed above the critical frequency $\Omega_c\cong 0.61$ as the mode changes from the synchronous (surfing) mode to the asynchronous (curtain) mode. For $\Omega<\Omega_c$, the toner speed is readily adjustable with frequency. But at frequencies sufficient to produce toner mass flow rates of practical interest, the toner speed is generally too high tier quality image development. For $\Omega>\Omega_c$, the toner move too slow for practical imaging applications.

Faced by the dilemma that no practical means of operating a traveling wave conveyor system for imaging purposes appeared possible, the idea of forcing toner close to a conveyor at high frequencies to speed up the asynchronous mode occurred to me and led to the present invention. A uniform normal force much greater than gravity can be produced by applying a DC bias field normal to the conveyor. The effect is manifest in the analysis by producing a much larger value of the "pseudo gravity" parameter G. A typical result for G=0.4 at Ω=0.75 is shown in FIG. 10. Note that the average speed, <U>—0.3, has increased by nearly a factor of 100 over the speed for G=0.01. Note also the significant change in character of the toner motion compared to either the curtain or surfing modes. The toner is thrust ahead (hunched) by each wave as it passes, alternately sliding in contact with the conveyor, then lifted off the conveyor by the next wave crest. When in contact with the conveyor surface, the Z-dimension is 0.07, the toner radius.

To distinguish this new mode from the others it is referred to as the "hunching" mode. The average toner speed vs. frequency for G=0.5 is compared to the average toner speed for G=0.1 in FIG. 11. Note that the higher G shifts the critical frequency ($\Omega_c$) for the onset of asynchronous motion to a slightly higher value. But most importantly, toner speeds in the asynchronous hunching range are greatly increased and within the range of practical interest for imaging applications. The most usefull speed range occurs for Ω between $\Omega_c$ and $3\Omega_c$. This speed range is dependent on M as shown in FIG. 12. The dependence of toner speed on G for different Ω and M=5 is shown in FIG. 13. A similar family of curves is obtained for different M. As previously defined, the parameter M is predominantly determined by the conveyor wave length and toner material. In general, the useful toner speeds for imaging applications are obtained with this new hunching mode for 0.05<G<0.9 and $\Omega_c<\Omega<3_c$. In this range, the toner movement is asynchronous and $\Omega_c$ is identified experimentally as the lowest frequency for asynchronous toner motion. This defines a crucial operating range claimed in the present invention. It should also be appreciated that another important attribute of the hunching mode is that the toner move in close proximity with the conveyor surface, at an average distance of <Z><1, as shown in FIG. 14. This feature provides the ability to deliver toner to a latent image at close range without the toner physically contacting the latent image bearing member, except in areas where the latent image, by design, attracts toner from the conveyor. This is key to obtaining a non-interactive development process. This property naturally accompanies the hunching mode when the toner are moved in the desired speed range, as defined above.

Examples showing use of the analysis to design conveyors for direct toner printing and xerographic development now follow. A conveyor of λ=0.4 mm and M=40 is considered. For direct printing a speed of 15 cm/sec, or <U>0.11 is typically desired. By analysis this toner speed is produced by Ω=0.45, and G=0.19. For special xerographic development applications a toner speed of 50 cm/sec may be optimal. Correspondingly <U>=0.37 is desired, which is produced by Ω=0.38 and G=0.41. Other toner speeds suitable for different applications can be similarly found via numerical solution of the equations of motion. All possible toner motions ensue from different choices for the three dimensionless parameters M, Ω and G.

It should be appreciated that since the analysis governs single particle motion, its use is limited to the design of the conveyor system and identification of its approximate operating conditions. Actual operating parameters must be fine tuned experimentally for optimal results. Air drag caused by the collective action of large numbers of toner moving together is expected to cause an upward shift in the threshold frequency ($\Omega_c$) for asynchronous motion. Compensation for this effect must be determined experimentally.

From experience and extensive analysis similar to the above I have realized that the operating conditions for a toner conveyor system which optimize the functions of loading a conveyor, charge filtering and delivery to a latent image are often incompatible. This has suggested to me the use of a segmented toner conveyor, with each segment separately optimized for its intended task. One or more segments are operated in the surfing mode for optimizing toner loading, charge filtering and general transport purposes. One segment is operated in the new hunching mode liar accepting toner form the loading or transport segment and conveying the toner past a latent image at the optimal speed. The over all performance of the conveyor system is thus improved dramatically. For certain special applications, a single conveyor operated in the new hunching mode will perform satisfactorily.

In multi-segmented conveyors it is necessary to make adjoining conveyor segments compatible. In particular, the mass flow of toner on the loading conveyor segment must be accommodated by every segment, including the delivery segment. More specifically the mass and charge per unit area transported in the slower hunching mode can not become so great that transport becomes blocked by toner pile-up on transfer from the faster surfing mode. This should not be a problem however, providing the speed reduction on transfer does not exceed the ratio of 10/1. This is because the toner coverage in the surfing mode is typically less than 10%. Phase matching of the waves on neighboring segments is unnecessary because transport on at least one of the two segments will be asynchronous. Toner transfer across the junction will be effected by toner momentum. Compatibility of operation of the different conveyor segments is therefore not a severely restrictive consideration.

The principles and analysis illustrated by the above examples can be applied to the design and operation of any segmented traveling wave conveyor system. It need only be remembered that final tuning of the operating conditions must be done experimentally. During such experimentation, a simple test to determine whether or not the toner moves synchronously with the wave is to examine the toner motion with a microscope using stroboscopic illumination. With the stroboscopic frequency at or near the wave frequency, the toner will appear in bands separated by one wavelength (or a half-wavelength with the presence of sufficient WST) when the toner particles move synchronously (as in the surfing mode). For any of the asynchronous modes, the toner will appear uniformly distributed over the conveyor, with no evidence of banding.

It is an object of the present invention to provide a means of delivering toner to a latent image with a speed and spatial distribution suitable for the format/on of high quality powder images.

Another object is to provide a segmented traveling wave toner conveyor system, with each segment operated to optimally perform its specific function. One segment loads toner onto a conveyor at a desired rate, one segment facilitates removal of toner of wrong polarity, and one segment delivers toner to a latent image at a preferred speed and spatial distribution in one embodiment of the invention, said latent image is created and transported on a photoreceptor surface, as used for xerographic copying or laser printing. In another embodiment of the invention, the latent image is created via a stationary printhead, as used in direct toner printing.

Another object is to provide a compact arrangement of components around a traveling wave toner conveyor system comprised of a loading/filtering segment and a delivery segment.

Another object is to deliver toner to a latent image bearing member (printhead, ion receptor or photoreceptor) without the use of a moving delivery member, such as a rotating donor roll, as frequently used in prior art.

Another object is to achieve a high level of toner charge purity while using a single component developer.

Still another object is to deliver toner to an image bearing member already carrying a previously developed (toned) image without disturbing (or interacting with) the previously developed toner. This so called non-interactive, or scavengeless, feature enables the formation of full color images on a single image receiver by using toner delivery systems containing different color toner in sequence, followed by only one transfer step in the cases of ionography and xerography, or no transfer step in the case of direct toner printing.

The invention, as described below, provides a new and improved means of charged toner conditioning and transport for the development of electrostatic latent images in xerography or ionography, or for delivering toner to electrostatically controlled apertures in a direct toner printing system.

SUMMARY OF THE INVENTION

The present invention provides a dry-toner conditioning and transport system with a segmented traveling wave toner conveyor consisting of at least two segments. One segment, referred to as a loading/filtering (LF) segment, accepts toner from a charged toner source, transports the toner past a WST extractor, and transfers the toner to the next segment. The LF segment is preferably operated in the surfing mode because of its special properties that facilitate charge filtering, or removal of WST from the conveyor. This must be done before the toner is delivered to its point of use. The second conveyor segment, referred to as the delivery (D) segment, then conveys the toner to a moving image-receiving member which accepts toner from the conveyor as needed to form a visible toner image. The motion of toner on this D segment is controlled for each application to enhance image quality.

In one embodiment of this invention, the image is generated in real time by a stationary printhead in a direct toner printing apparatus, i.e., a toner image is formed on an image receiver as it passes the opposite side of the printhead.

In another embodiment of this invention, a latent image, or charge pattern, is formed on the surface of a moving dielectric layer (as in ionography) or a photoreceptor (as in xerography), and toner is attracted from the conveyor to the latent image as the latter moves past the delivery segment.

Any toner not extracted from the D segment by a latent image moves onward to a third segment of the conveyor, or an extended portion of the first segment if the conveyor system forms a closed loop. Unused toner is then removed from the conveyor, neutralized and returned to the sump of the toner loading device.

Segmentation of the conveyor in the above manner makes it possible to operate the segments independently so the operation of each segment can be tuned to its optimum performance. Specifically, the LF segment is tunable to optimize the mass transport rate of toner and the removal of WST. The delivery segment is tunable to deliver toner to the image receiver in a manner to avoid image defects. As pointed out earlier by numerical examples, the mode of transport on the separately optimized segments is different, so the segmented conveyor system provides a great advantage over any single segment conveyor system.

The present invention includes single segment conveyor systems operated in the hunching mode. This allows for the conditioning and delivery of toner to a latent image with a conveyor system requiring only one multiphase voltage source. Operation of the complete conveyor in the hunching mode overcomes the inherent limitations of either the surfing or the curtain modes. It allows optimized delivery to a latent image with the least sacrifice in loading and charge filtering. The advantage is a lower cost conveyor system.

Accessory components for loading and unloading the conveyor system can assume a variety of forms. Specific examples are described below. One form is especially important because it requires no moving parts. The toner are mobilized via air and charged via a corona system. The advantages of a toner delivery system with no moving parts are long life, durability and precision control over the toner delivery process.

DETAILED DESCRIPTION OF THE DRAWINGS

Figure 5A:
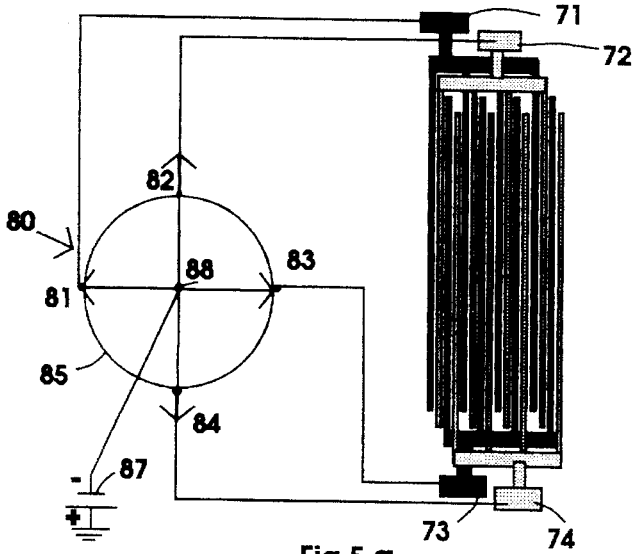
Figure 5B:
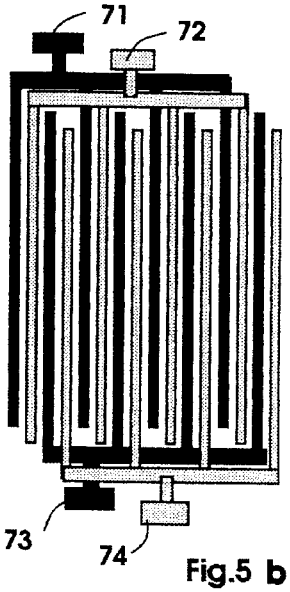

FIGS. 5*a* and 5*b* respectively show compressed and stretched versions of a conveyor delivery segment.

Figure 6:
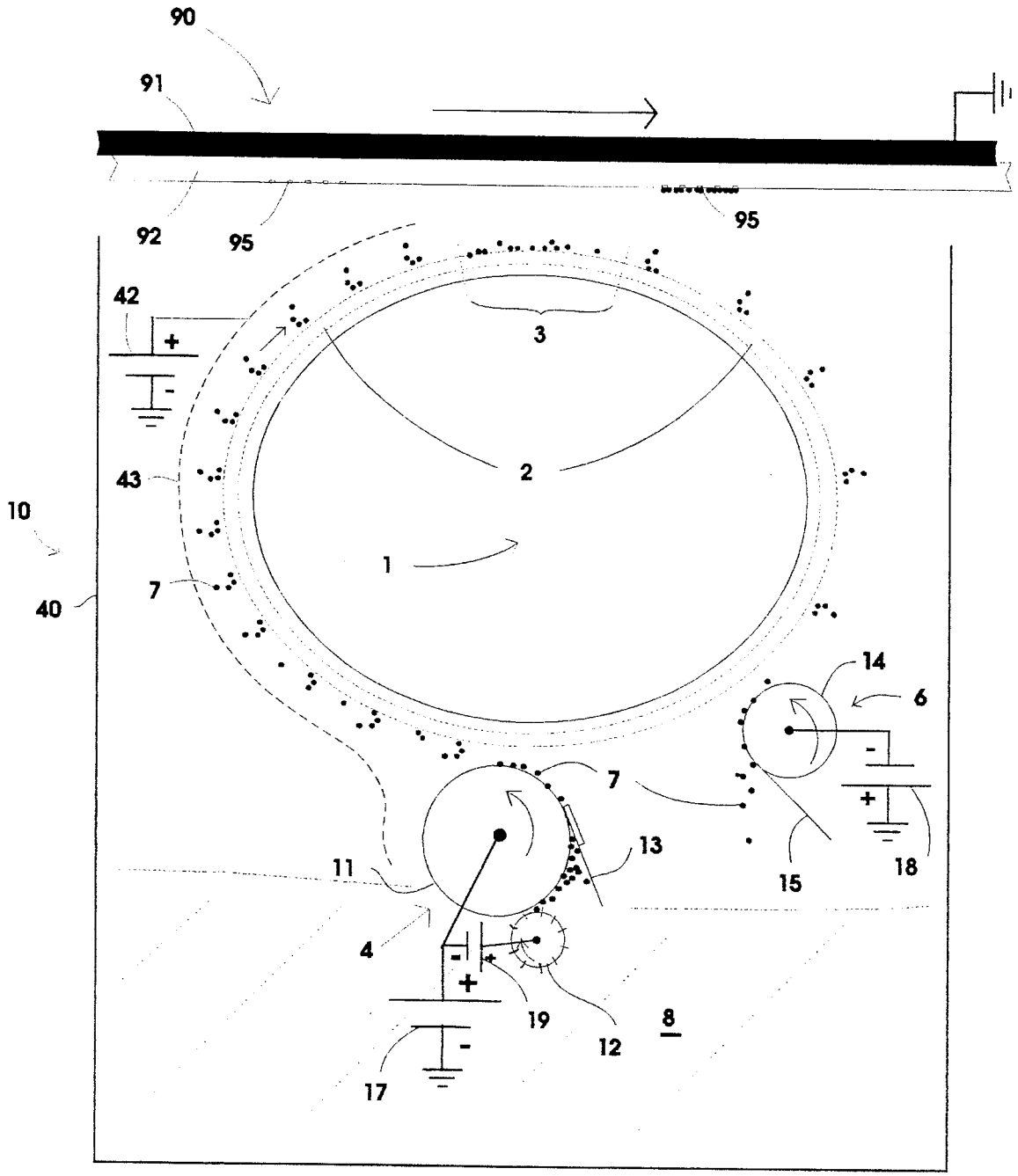

FIG. 6 is a schematic diagram of another form of toner delivery system.

Figure 7:
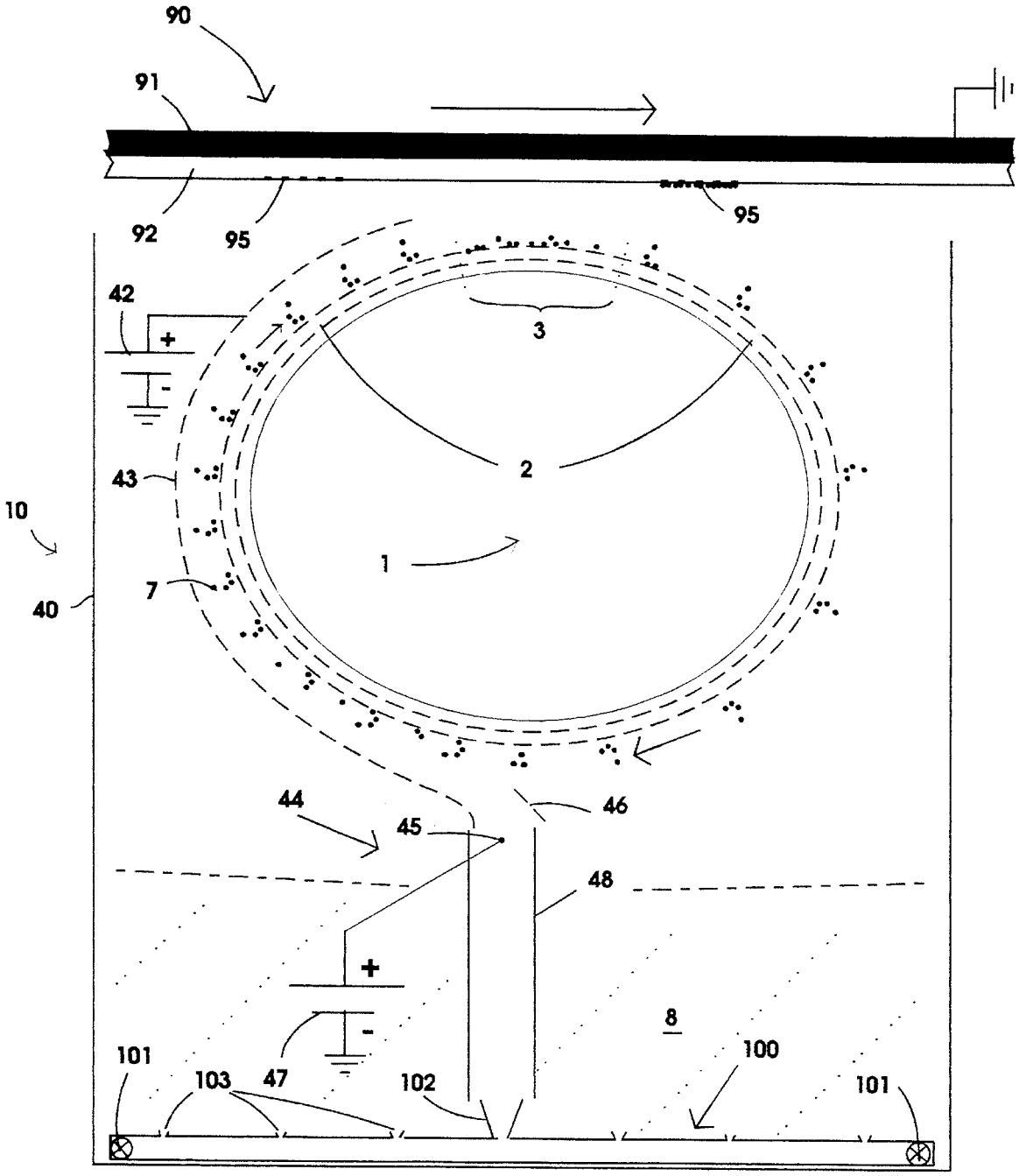

FIG. 7 is a schematic diagram of still another form of toner delivery system.

Figure 8A:
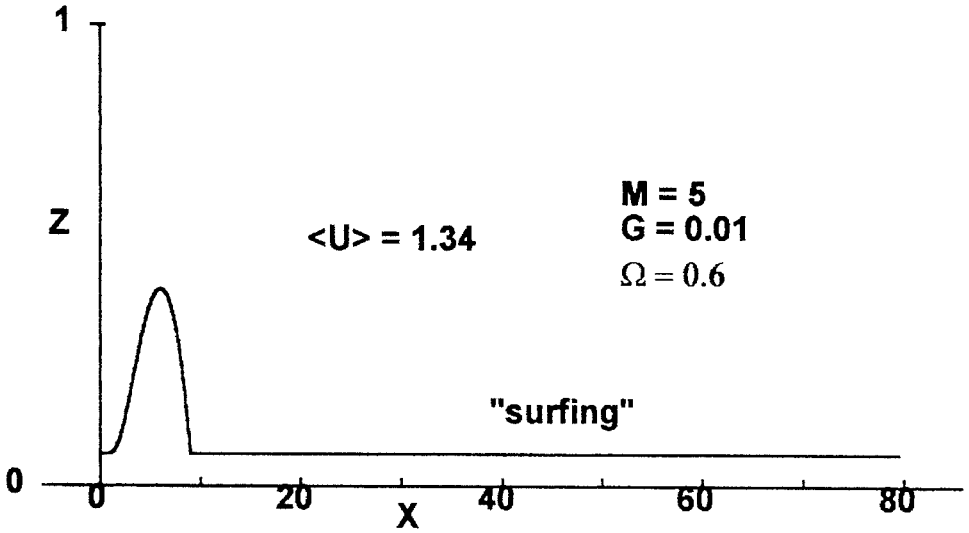
Figure 8B:
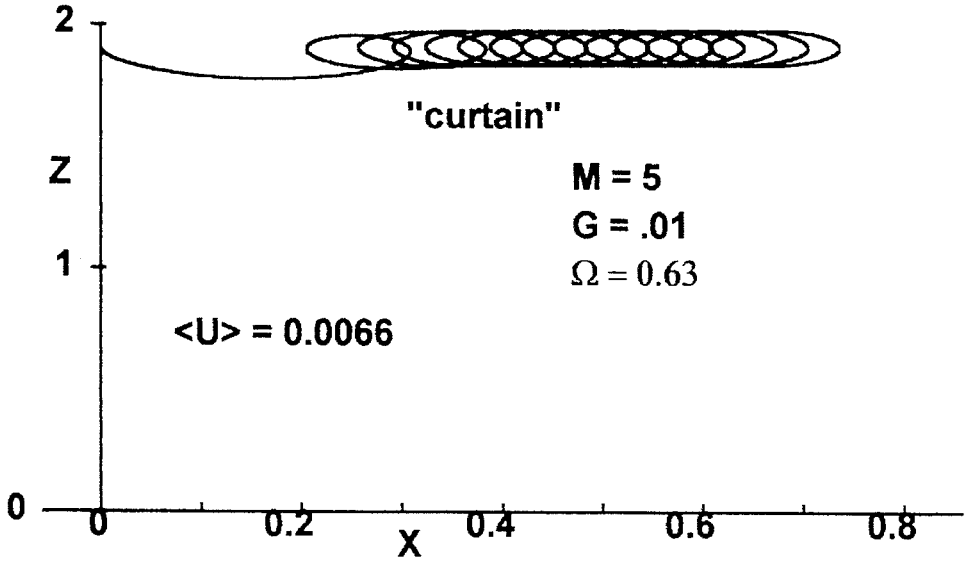
Figure 8C:
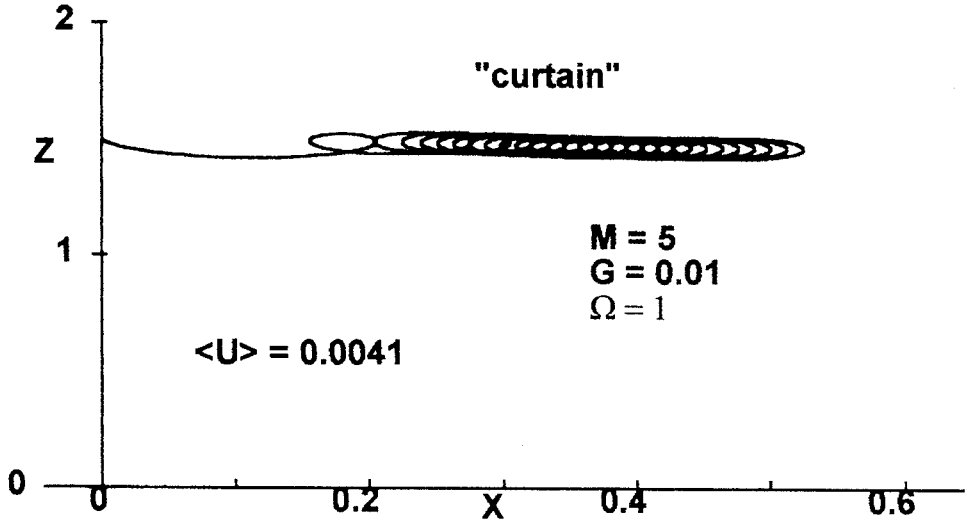

FIG. 8*a*, 8*b* and 8*c* are graphs comparing the surfing mode of transport to the curtain mode of transport at two different frequencies.

Figure 9:
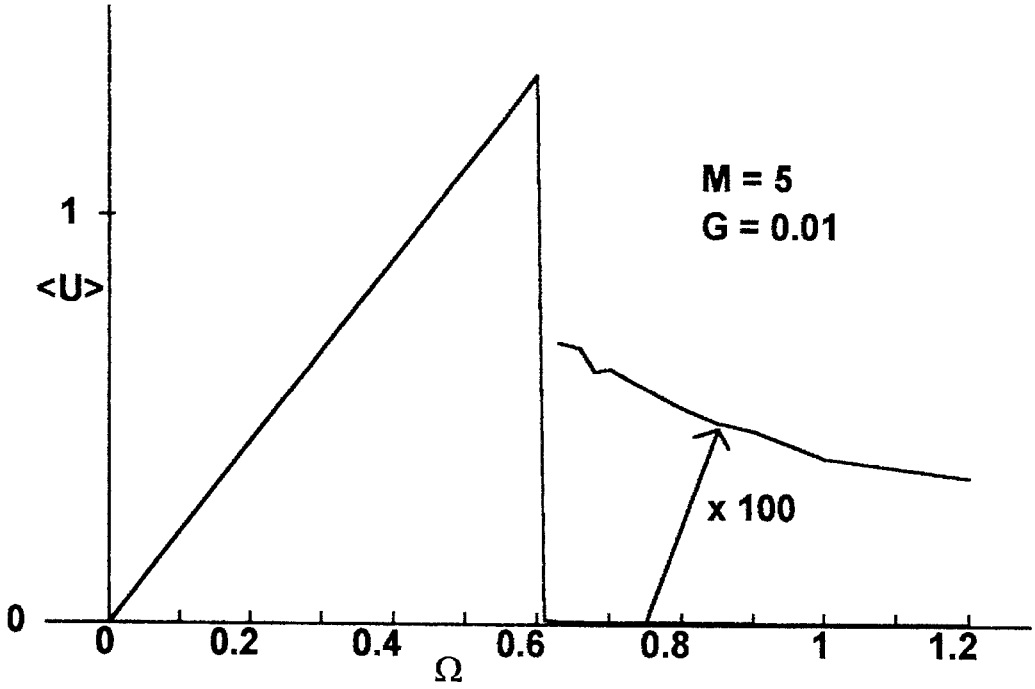

FIG. 9 is a graph showing the dependence of average toner speed, <U>, on wave frequency, Ω, in dimensionless units.

Figure 10:
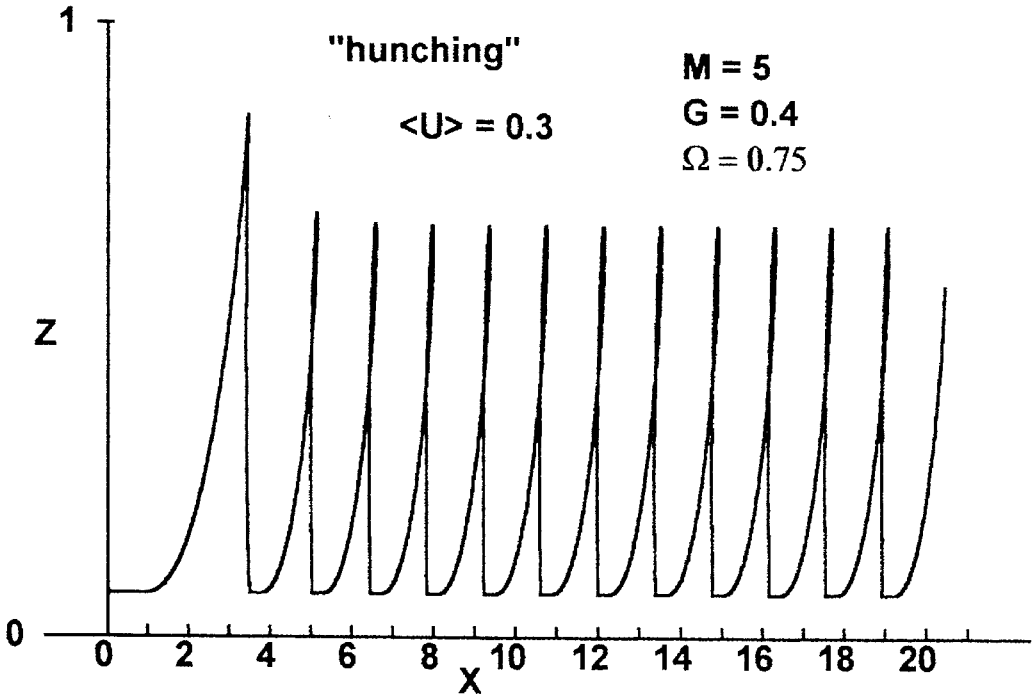

FIG. 10 is a graph of a toner path in the new hunching mode of transport.

Figure 11:
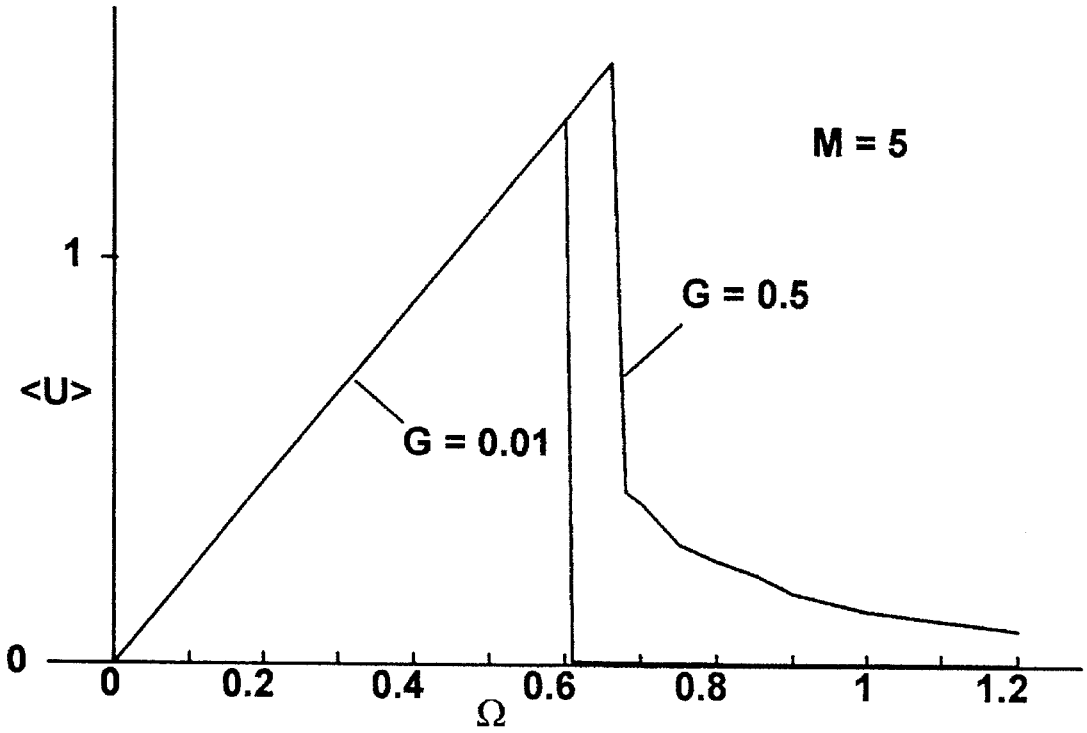

FIG. 11 is a graph, for M=5, showing the change in average toner speed vs. frequency produced by increasing G from 0.01 to 0.5.

Figure 12:
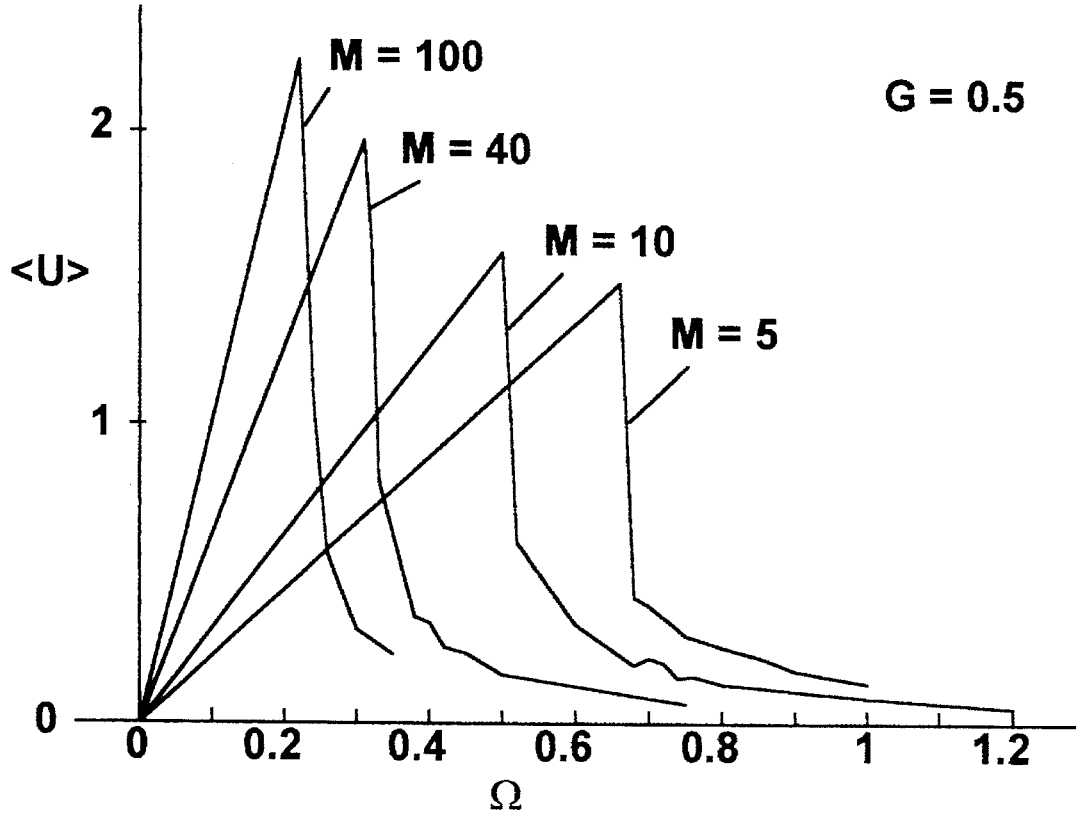

FIG. 12 is a family of graphs for different M showing the dependence of average toner speed on frequency.

Figure 13:
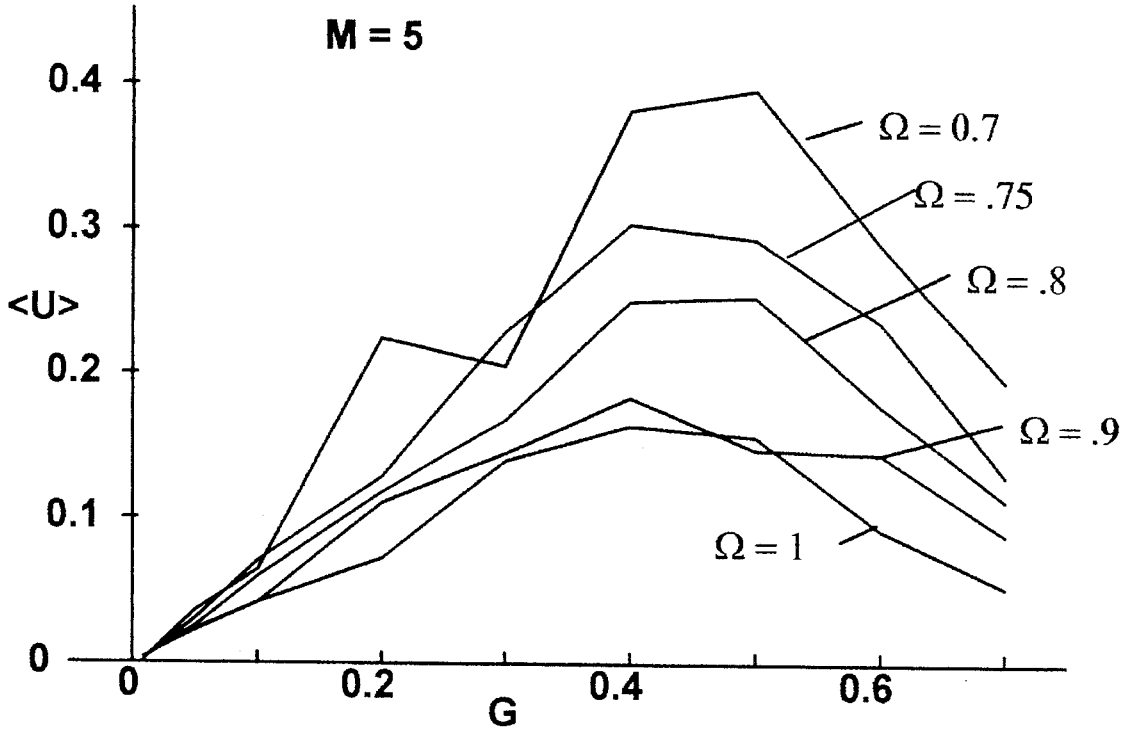

FIG. 13 is a family of graphs for different frequencies showing the dependence of average toner speed on G.

Figure 14:
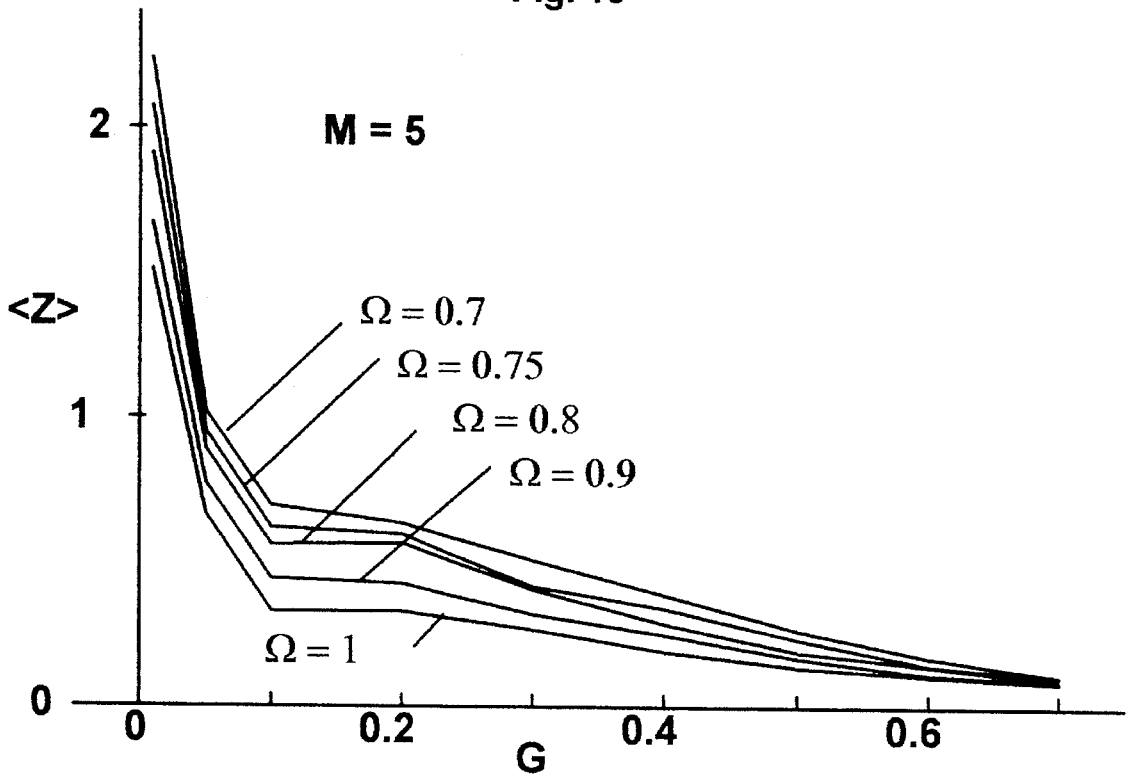

FIG. 14 is a family of graphs for different frequencies showing the dependence of average toner distance from conveyor surface, Z, on G.

Figure 15:
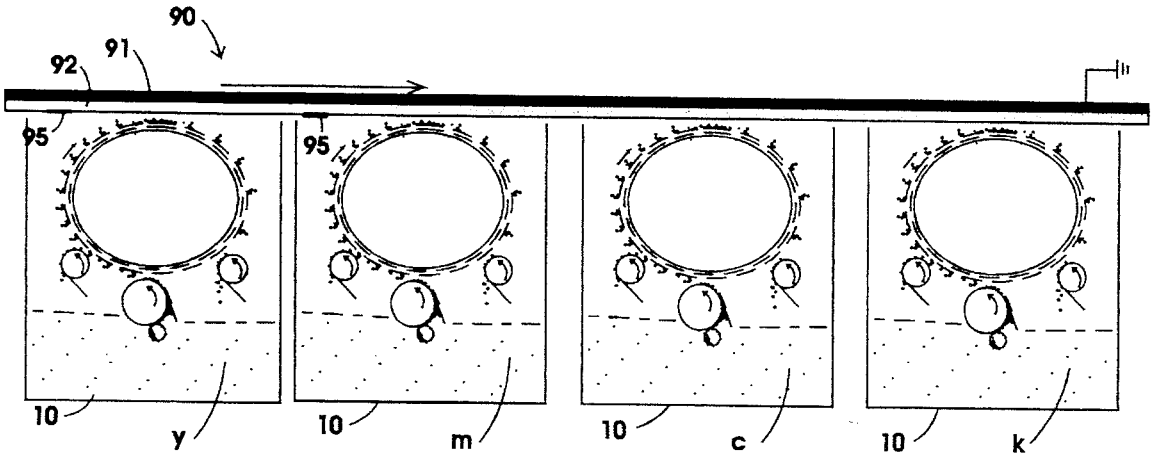

FIG. 15 is a schematic of a single-pass color development system with four toner delivery systems in tandem, each containing different color toners (y, m, c, k) yellow, magenta, cyan and black.

DESCRIPTION OF PREFERRED EMBODIMENTS

Figure 1:
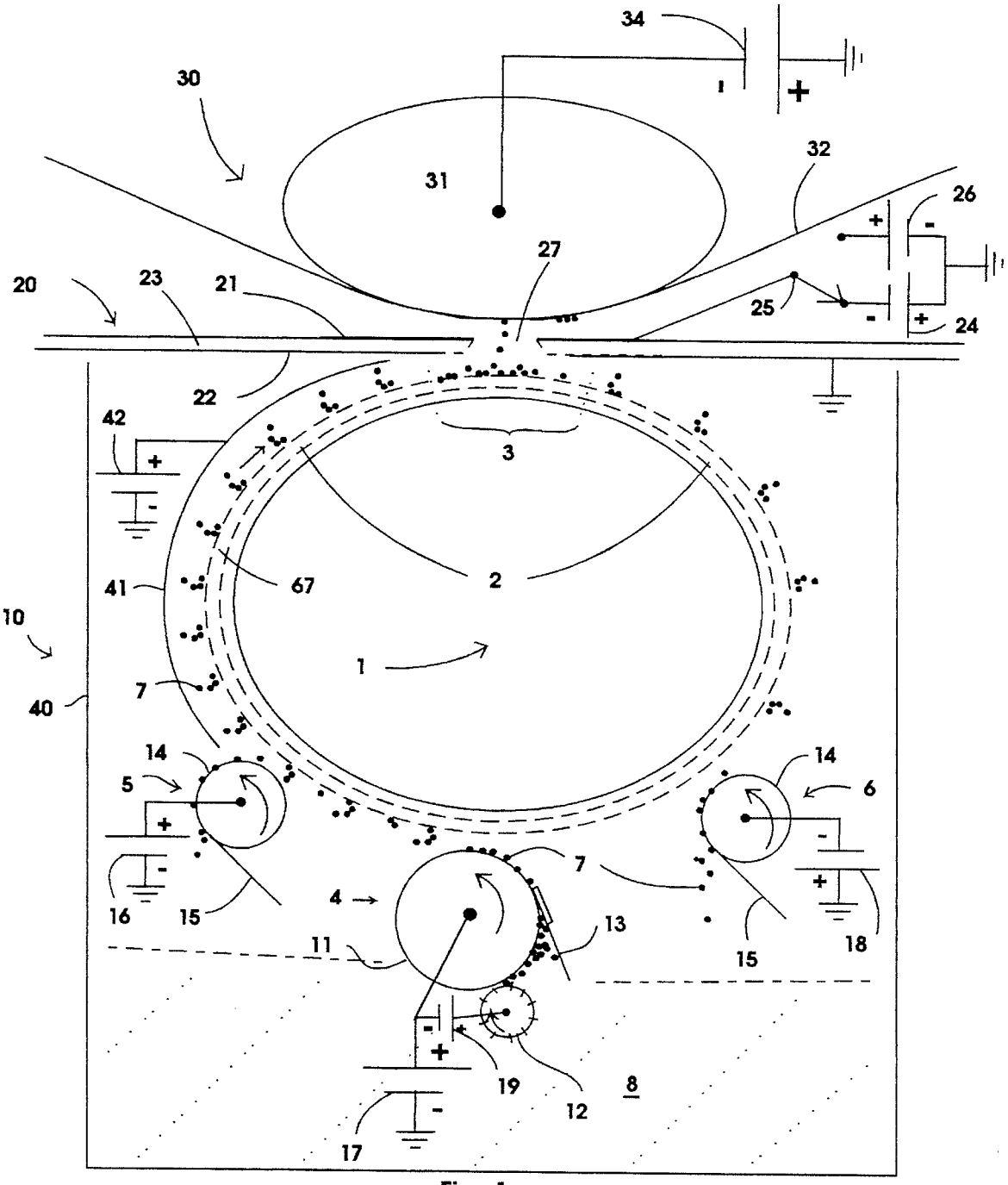
FIG. 1 is a schematic diagram of a direct electrostatic printer according to this invention.

A direct toner printing apparatus illustrating the use of this invention is shown in FIG. 1. This apparatus includes a traveling wave toner delivery system 10, a printhead 20, and a paper transport system 30.

The paper transport system 30 includes a backing electrode, or shoe 31, an image receiver 32, and a voltage source 34 operatively connected to the backing electrode 31.

The printhead 20 includes an array of apertures through a dielectric film 23 coated on one side with a continuous metal film, or shield electrode 22, and on the other side by a segmented metal film with each segment, or control electrode 21, surrounding one aperture 27. Aperture 27 is one of an elongated array of apertures in three or more rows which extend the width of the paper. Control electrode 21 is alternatively connected to voltage sources 24 and 26 by a switch 25. The switch 25 selectively changes the electric field in the neighborhood of aperture 27 to either effect or prevent the transfer of toner from the delivery system 10 to the image receiver 32. In effect, the electric field at aperture 27 acts as an electrostatic shutter which opens or closes for the passage of toner 7 from the delivery system 10 to the image receiver 32. The polarity of the voltage sources 24, 26 and 34 indicated in the FIG. 1 tacitly assumes a toner of positive polarity. It will be appreciated that the polarities and magnitudes of these voltage sources will be set, in general, to achieve the desired control of toner supplied via the delivery system 10. Switch 25 is operated via a control system (not shown) to open or close the electrostatic shutter at aperture 27 in accordance with a digital representation of the image to be formed on the image receiver 32.

The toner delivery system 10 includes a segmented traveling wave conveyor 1, toner charging/metering means 4, WST extractor 5, RST extractor 6, and toner sump 8, all housed in an enclosure 40. The segmented conveyor 1 is stationary, and includes at least two separately operable segments: a loading/filtering (LF) segment 2, and a delivery (D) segment 3. The LF segment 2 is preferably operated in the surfing mode to enable charge filtering (by extraction of WST from the conveyor), and a high toner loading rate. The D segment 3 is operated to optimally control the motion of the toner as it is delivered to the printhead 20. Toner on segment 3 preferably moves in the "hunching" mode with the toner drift speed adjusted via the control parameters Ω and G to be compatible with the speed of the image receiver 32.

Figure 3:
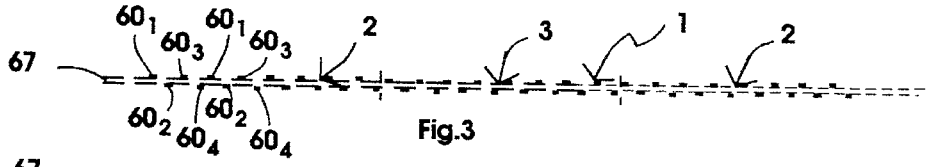
FIG. 3 is an edge view of a segmented traveling wave toner conveyor.
Figure 4:
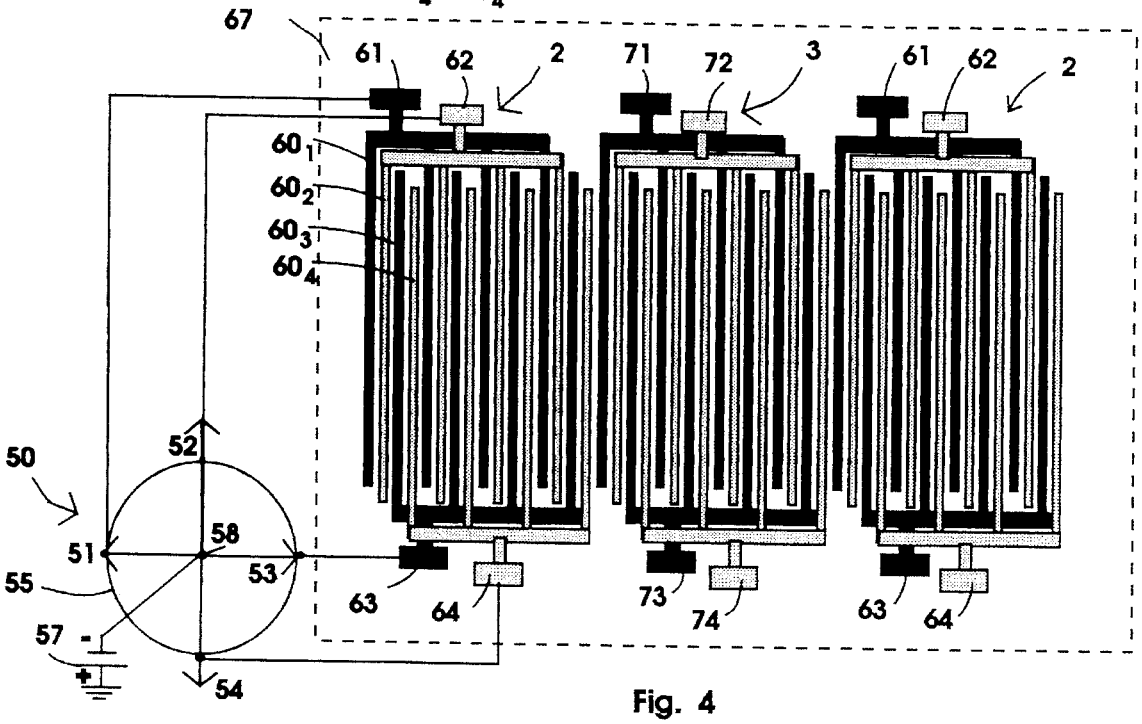
FIG. 4 is a plan view of the segmented traveling wave toner conveyor shown in FIG. 3.

To operate and optimize the LF and D segments independently, they must be electrically isolated and separately powered. A conveyor structure and power sources for driving the separate conveyor segments are illustrated in FIGS. 3–5. FIG. 3 is a partial edge view of the conveyor 1 (shown flat) with its D segment 3 (bounded by phantom vertical lines) between opposite ends of its LF segment 2. As shown in FIG. 1, the conveyor segments 2 and 3 together form a closed loop conveyor system. That portion of the conveyor 1 between the unused toner extractor 6 and the loading device 4 transports no toner and may be removed if desired with no impact on the operation of the device. The two sections of segment 2 are connected in parallel to a power source 50 as explained below. In general, the conveyor segments 2 and 3 share a common support member 67, which is a thin, high dielectric strength film, such as polyimide, adapted to be shaped into the elliptical shape shown in FIG. 1. The preferred thickness of the support member 67 is 50 microns (micrometers) or less. The electrodes in the LF segment 2 form a periodic array with the sequential arrangement $\mathbf{60}_1$, $\mathbf{60}_2$, $\mathbf{60}_3$ and $\mathbf{60}_4$, repeated as necessary to build up the segment to the desired length. All electrodes of a common phase, such as $\mathbf{60}_1$, are connected via an edge bus to a connection pad, such as 61. The odd numbered electrodes, $\mathbf{60}_1$ and $\mathbf{60}_3$, form an interdigitated pattern on one side of the support member 67. The even numbered electrodes, $\mathbf{60}_2$ and $\mathbf{60}_4$, form an identical pattern on the opposite side of support member 67. The electrodes are so positioned (laterally in FIG. 4) that the even numbered electrodes are midway between the odd numbered electrodes. The opposing patterns are also displaced in the orthogonal direction (vertically in FIG. 4) so the edge busses are in a relationship to produce a desired interelectrode capacitance. The non-overlapping case shown in FIG. 4 constitutes a displacement which minimizes this interelectrode capacitance.

Conveyor segment 2 is connected to power source 50 in the manner shown if FIG. 4. Power source 50 includes a 4-phase generator 55, and a DC bias supply 57 connected to the common terminal 58 of the 4-phase generator. The 4-phase generator is represented in FIG. 4 as a conventional rotating vector diagram, showing the desired 90° phase relationship between the four phases. Electrical leads from contact pads 61, 62, 63 and 64 of segment 2 are electrically connected respectively to terminal 51, 52, 53 and 54 of the 4-phase generator 55. (To avoid undue confession of lines in FIG. 4, only one section of segment 2 is shown connected to the source 50.) The magnitude of the DC bias voltage of supply 57, determined by experimentation, is sufficient to avoid attraction of toner from the conveyor to neighboring objects such as the grounded shield electrode 22 of the printhead 20. Referring to FIG. 1, the shield electrode 41 is biased by voltage from source 42. The voltage of the source 42 is set relative to the voltage of the source 57 to produce a bias field $E_b$ acting on the shielded section of segment 2. This bias field physically determines the parameter G which is tuned in conjunction with the frequency of 4-phase generator 55 and the voltage of source 16 of the WST extractor 5 to maximize the rate of toner transport on the conveyor system 1.

Referring now to FIG. 5, the conveyor segment 3 is similarly connected to a four-phase generator 85 in power source 80, with terminals 81, 82, 83 and 84 respectively connected to connection pads 71, 72, 73 and 74 of segment 3. This arrangement of connections is shown in FIG. 5 to avoid undue complexity in FIG. 4. A direct current voltage source 87 is connected to the common terminal 88 of generator 85. The amplitude and frequency of the voltages supplied by generator 85, in combination with the DC bias of source 87, control the movement of toner on the conveyor segment 3. These physical quantities determine the dimensionless parameters Ω and G required to produce the optimal toner motion on the D segment 3. Different values of these parameters are required for each application. The ability to tune these parameters for optimal toner movement on segment 3 without detuning the operation of segment 2 generally requires the use of separate power sources for driving the two segments. In an application where the physical parameters of power source 80, found to produce the optimal toner movement on segment 3, will also load and filter toner at an adequate rate, then segments 2 and 3 can be driven by a single power source. This will reduce the cost of the toner delivery system. Operation of the conveyor system in the newly discovered hunching mode makes this possible for special applications.

The voltage amplitudes $V_1$, $V_2$, $V_3$ and $V_4$, represented by vectors at terminals 51, 52, 53 and 54 of generator 50, for example, are indicated as being of different magnitude. The even indexed voltages, $V_2$ and $V_4$, at terminals 52 and 54, are indicated to be larger than the odd indexed voltage $V_1$ and $V_3$, at terminals 51 and 53. This is done to produce a more uniform wave amplitude on the side of the conveyor where the toner is transported. It is assumed that the toner are transported on the side of the conveyor where the odd numbered electrodes $\mathbf{60}_1$ and $\mathbf{60}_3$ reside (i.e., the top side of FIG. 3). The even numbered electrodes $\mathbf{60}_2$ and $\mathbf{60}_4$ are therefore at a greater distance from the toner in transport. To compensate for this greater distance the even voltage amplitudes $V_2$ and $V_4$ are increased relative to the odd amplitudes $V_1$ and $V_3$, producing approximately equal field strengths (as seen by the toner) for all four phases.

The ratio $V_2/V_1$ of voltage amplitudes required to produce the desired uniform field strength for the even and odd phases can be determined either by analysis, or by experimentation. For example, a proven experimental technique is to mount a segment of the conveyor system in place of a photoreceptor in a xerographic test bench. DC voltages applied to terminals 61 and 62, with terminal 63 and 64 grounded, then produces a static field above the conveyor which can be developed by any conventional xerographic development technique. The ratio of DC voltages applied to terminals 62 and 61 that attract equal amounts of toner onto these electrodes is the appropriate ratio for the phase amplitudes $V_2/V_1$ and $V_4/V_3$ in setting up the 4-phase generators.

The 4-phase conveyor system described above is preferred because it creates a nearly sinusoidal traveling wave with an easily manufactured conveyor structure. It will be appreciated however that any conveyor system based on the use of three or more phases can be similarly segmented and optimized for operation, and is within the spirit of this invention. Operation of different segments with different numbers of phases to achieve special effects is also within the spirit of this invention.

The toner delivery system 10 in FIG. 1 is equipped with a conveyor system 1 as described in detail above, a toner applicator 4, a WST extractor 5 and an unused-toner extractor 6. Applicator 4 includes a donor roll 11, a pre-loading charging means 12, a charging/metering blade 13, a DC bias source 19 and an AC source 17. These components are common in single component development systems and their use in applying toner 7 to a latent-image bearing member, such as a photoreceptor, is well known. The WST extractor 5 includes a rotating metal rod 14 and a cleaning blade 15. Blade 15 may be metallic or any blade-cleaning device normally used to clean photoreceptors or electroreceptors. The WST extracted from the conveyor, by the bias field from voltage source 16, is discharged (neutralized) in the process of cleaning the rod 14, and the neutralized toner falls under gravity into toner supply sump 8. The unused-toner extractor 6 is identical to the WST extractor 5, except that its voltage supply 18 is of the opposite polarity to attract unused RST from the conveyor segment 2. All components of the toner delivery, system 10 are within housing 40. The shield electrode 41 may be extended over as much of the conveyor segment 2 as required. While the toner delivery system is described here as a closed loop with two segments, the invention is obviously applicable as well to an open conveyor system, or to systems with any number of segments. The central point of the invention is that the conveyor includes a plurality of separate and distinct segments, with each segment separately and optimally operated for its intended purpose, and thereby achieve results heretofore unattainable.

In general, the toner applicator 4 and its supply 17 in combination with power source 50 will be operated to transport toner at an optimal rate (typically the maximum) on conveyor system 1. The conveyor segment 3 is separately operated in its own optimal manner for each particular application.

FIG. 1 shows a toner delivery system for a direct toner printing apparatus. This apparatus includes a printhead 20 and a backing electrode 30, in addition to the toner delivery system 10. Printhead 20 includes a control electrode 21 and shield electrode 22 affixed to the surface of a thin dielectric film 23. An aperture 27 through the electrodes and dielectric film provides a passage for toner to move from segment 3 of the toner delivery system 10 to a receiver member 32, as the latter is drawn over a backing electrode 31. Toner passage through the aperture 27 is controlled by voltage applied to control electrode 21 via switch 25. For positive toner, as assumed for the present illustration, toner passage through aperture 27 prevails when the switch 25 is connected to supply 24, as indicated, and toner passage stops when the switch 25 is connected to voltage source 26. Printhead 20 generally includes an array of apertures 27 with switches 25. The array of switches 25 are digitally controlled via computer to deposit toner imagewise on the receiver 32 to generate the desired image. Different methods of direct toner printing are known, examples including Direct Electrostatic Printing (DEP, U.S. Pat. No. 4,814,796) and Toner Jet® (recent trademark by Array Printer AB, Molndal, Sweden of process described in U.S. Pat. No. 5,036,341). The present toner delivery system, incorporated in either printing system provides means of achieving improved image quality of the prints.

Figure 2:
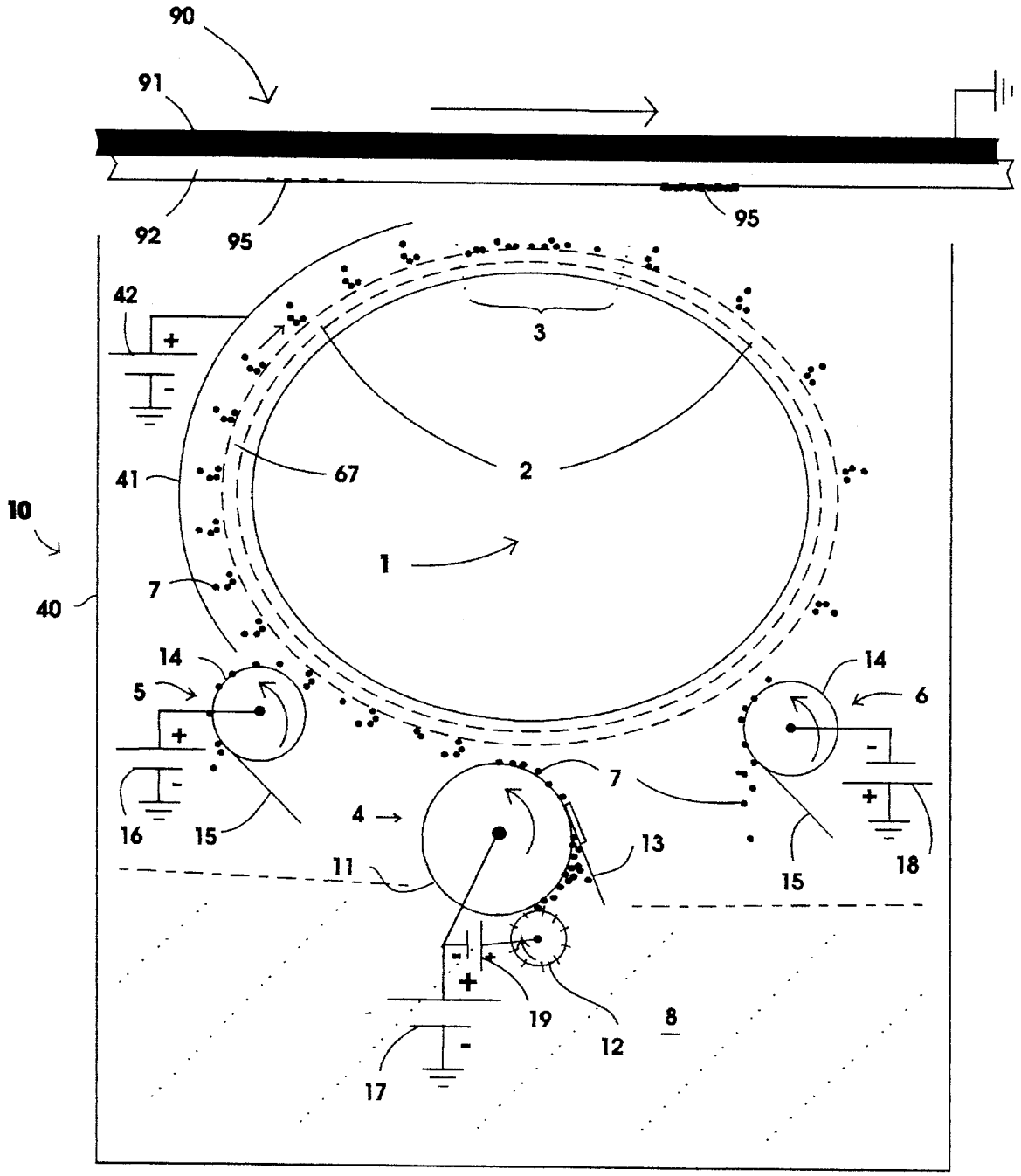
FIG. 2 is a schematic diagram of a xerographic engine according to this invention.

A second embodiment of the present invention involves use of the toner delivery system 10 as a xerographic or an ionographic development system. This application is indicated in FIG. 2, where, tier clarity, only a portion of a latent image bearing member 90 is included in the diagram. The latent image bearing member 90 includes a dielectric (or photoconductive) layer 92 over a conductive backing 91. This conductive backing 91 may be grounded as in FIG. 2, or biased to any desired potential relative to ground, An electrostatic latent image 95 is formed on the surface of the dielectric (or photoconductive) layer 92 via an ion deposition (or image exposure) step, not shown. The latent image bearing member 90 carries the latent image 95 past the toner delivery system 10 at a speed, indicated by the arrow, that is dependent on the application. Segment 3 of the conveyor system 1 is operated to move toner to the latent image at a speed that produces the best quality developed image. The optimal speed is expected to be no more than 5 cm/sec faster than the speed of the latent image, though the true optimum must be found by experimentation for the materials and speed of each specific application. The amplitude and frequency of 4-phase generator 85 and bias voltage 87 are tuned to produce the best quality developed image. By way of example, suppose the application is xerographic and the photoreceptor is moving at 45 cm/sec. Assume further the conveyor structure and toner material result in M=40. By analysis, the combination of $\Omega$=0.38 and G=0.41 is predicted to produce a toner speed 50 cm/sec. The corresponding physical parameters required to yield these values of $\Omega$ and G are f=7 kHz and $V_1$=270 volts for generator 85 and $V_b$=1600S volts for bias voltage 87, where S is the spacing in millimeters between the surface of latent image bearing member 90 and the conveyor segment 3. Since conveyor system 1 is a non-moving part, a representative value of S might typically be as small as 0.1 mm, for which $V_b$ becomes 160 volts. It is stressed that the operating values predicted by single particle analysis in this example simply provide starting values for an optimization procedure. The true optimal values determined by an experimental variation-of-parameters procedure will be somewhat different. Approximate operating values for other latent image speeds, materials and conveyor structures can be found and fine tuned experimentally in a similar manner.

Various accessories to the conveyor system 1 in the toner delivery system 10 are contemplated. For example, the shield electrode 41 might be replaced by an added traveling wave conveyor 43, and driven by a multi-phase generator so that the direction of wave propagation is toward the WST extractor 5. The conveyor 43 will continuously collect any newly generated WST in transport on segment 2 and remain clean. Another arrangement, shown in FIG. 6, is to eliminate the WST extractor 5 and extend the WST conveyor 43 into proximity with the donor roll 11 of the toner loading device 4. The returning WST will thus be deposited on the donor roll, and carried thereon to a precharging roll 12 where the WST is mixed with new supply toner, and recharged. Still another option is to remove the unused toner extractor 6, and allow unused right sign toner to mix with new toner being added to the conveyor system 1 by the loading device 11. The advantage of such accessory components in the toner delivery system 10 is to reduce the number of moving parts and thereby to obtain a more reliable, longer lasting system.

Finally, a toner delivery system with no moving parts is illustrated in FIG. 7. Here the toner loading device 44 includes a vertical channel 48 extending the length of the toner conveyor system 1, an air distribution system 100, and a corona wire 45 operated with voltage from the source 47. The voltage source 47 is controlled to emit a desired level of corona current from the wire 45. An appropriate current control system, not shown, is well known in the art of control electronics. The air distribution system 100 receives air from a source of compressed air, not shown, through flow control ports 101, and releases said air through orifices 103 and 102. There are numerous orifices 103 in a two dimensional array, to maintain the toner supply 8 in a mobile, or nearly fluidized state. Orifices 102 are in a line or row in registry with the vertical channel 48 to keep the vertical channel 48 filled with a fluidized bed of toner. The orifices 102 are adjustable, to control the flow of air and toner through the vertical channel 48 and maintain the channel constantly full. The corona wire 45 attracts WST from the conveyor 43 and spews a "fountain" of right sign toner toward the conveyor segment 2. A conveyor segment 46 may be included as an accessory to enhance the supply rate of charged toner. Segment 46 is operated in the hunching mode, or the "curtain" mode in the manner taught by Masuda. Any WST propelled onto the conveyor segment 2 are removed by the conveyor 43 and returned to the corona wire 45 for recharging. The toner loading rate of the conveyor system 1 is controlled by the combination of air flow through orifices 102 and the corona current from wire 45.

Several toner delivery systems of the type described above can be operatively connected in tandem to deliver different color toner to a single image receiver as shown in FIG. 15. Each system is separately controlled to deliver toner to the image receiver with optimal speed and distance from the image receiver. This enables the formation of high quality toner-images while avoiding interaction with, or scavenging of toner already acquired by the image receiver from preceding toner delivery systems. For the case of image receivers in the form of a latent image bearing member, as shown in FIG. 15, the latent image may be changed or modified between the toner delivery systems, by means not shown in FIG. 15, but well known in the art of xerography. Alternatively, a single image may be multiply developed with different types or colors of toner.

In the following claims the term "right sign toner" means toner of desired electrostatic polarity, and "wrong sign toner" means toner of the opposite polarity.

What is claimed is:

1. A toner transport system for charging and delivering right-sign electrostatic toner to an image receiving member, including:

a traveling electrostatic wave toner conveyor including a loading/filtering segment and a delivery segment, said segments each including a plurality of parallel electrodes operatively connected to a source of DC-biased multiphase electric power to establish a traveling electrostatic wave in said segment; and said delivery segment disposed adjacent to said receiving member to deliver toner thereto, said traveling electrostatic wave in said delivery segment effective to move toner in an asynchronous hunching mode to said image receiving member.

2. A toner transport system as defined in claim 1, further including:

a toner loading device adjacent to said conveyor to gather toner from a supply thereof and to charge and transfer said toner to said loading/filtering segment of said conveyor at a desired rate;

a first toner extractor adjacent to said conveyor on one side of said delivery segment, and electrically biased to a polarity to extract wrong-sign toner from said conveyor; and a second toner extractor adjacent to said conveyor downward of said delivery segment in the direction of said electrostatic waves, and electrically biased to a polarity to extract unused right-sign toner from said conveyor.

3. A toner transport system as defined in claim 1, wherein said loading/filtering segment and said delivery segment of said conveyor are combined in one segment for charging and delivering said right-sign toner to said image receiving member.

4. A toner transport system as defined in claim 1, wherein said conveyor forms a closed loop for recalculating unused toner.

5. A toner transport system as defined in claim 1, wherein said traveling electrostatic wave in said delivery segment is subject to control by control of the bias $E_b$, amplitude $E_o$ and frequency f of said DC-biased multiphase electric power on said delivery segment to thereby control the distance Z of said toner from the surface of said conveyor.

6. A toner transport system as defined in claim 5, wherein $0.05<E_b/E_o<1$, and frequency f is in the range between 1× and 3× the threshold frequency to establish said asynchronous hunching mode.

7. A toner transport system as defined in claim 5, wherein the speed of toner movement to said image receiving member is subject to control by control of the bias $E_b$, amplitude $E_o$ and frequency f of said DC-biased multiphase electric power on said delivery segment.

8. A toner transport system as defined in claim 7, wherein $0.05<E_b/E_o<1$, and frequency f is in the range between 1× and 3× the threshold frequency to establish said asynchronous hunching mode.

9. A toner transport system as defined in claim 1, wherein said image receiving member is a final image bearing member in a direct powder printing process.

10. A toner transport system as defined in claim 1, wherein said image receiving member is a latent image bearing member.

11. A toner transport system as defined in claim 10, wherein said latent image bearing member is a xerographic photoreceptor.

12. A toner transport system as defined in claim 10, wherein said latent image bearing member is an ion charged dielectric.

13. A toner transport system for charging and delivering right-sign electrostatic toner to an image receiving member, including:

a segmented traveling electrostatic wave toner conveyor including a loading/filtering segment and a delivery segment;

said load/filtering segment having parallel electrodes operatively connected to a first source of DC-biased multiphase electric power to establish a traveling electrostatic wave in said loading/filtering segment;

said delivery segment having parallel electrodes operatively connected to a second source of DC-biased multiphase electric power to establish a traveling electrostatic wave in said delivery segment;

said loading/filtering segment disposed adjacent to said delivery segment to supply unipolar toner thereto, said delivery segment disposed adjacent to said image receiving member to deliver toner thereto; and a toner loading device adjacent to said conveyor to gather toner from a supply thereof and to charge and transfer said toner to said loading/filtering segment of said conveyor at a desired rate.

14. A toner transport system as defined in claim 13, wherein said traveling electrostatic wave in said loading/filtering segment is effective to move toner in a synchronous surfing mode to said delivery segment, and said traveling electrostatic wave in said delivery segment is effective to move toner in an asynchronous hunching mode to said image receiving member.

15. A toner transport system as defined in claim 14, wherein said traveling electrostatic waves in said loading/filtering segment and in said delivery segment are subject to separate control by control of the bias, amplitude and frequency of respective DC-biased multiphase electric power on said segments.

16. A toner transport system as defined in claim 14, wherein said electrostatic wave in said delivery segment is subject to control by control of the bias, amplitude and frequency of said DC-biased multiphase electric power on said delivery segment to thereby control the distance z of said toner from the surface of said conveyor.

17. A toner transport system as defined in claim 13, wherein said traveling electrostatic wave in said loading/filtering segment is effective to move toner in a synchronous surfing mode to said delivery segment, and said traveling electrostatic wave in said delivery segment is effective to move toner in an asynchronous hunching mode to said image receiving member, the speed of respective toner movements on said segments being subject to separate control by control of the bias, amplitude, and frequency of the respective DC-biased multiphase electric power on said segments.

18. A toner transport system as defined in claim 13, further including a wrong sign toner (wst) traveling wave conveyor extending over and parallel to said loading/filtering segment, said wst conveyor operatively connected to a third source of DC-biased multiphase electric power to establish a traveling electrostatic wave in said wst conveyor to extract and convey wrong-sign toner from said segmented toner conveyor.

19. A toner transport system as defined in claim 13, said toner loading device including means to generate a fluidized bed of toner above said supply, and a corona wire to emit corona current toward said loading/filtering segment to thereby charge and move toner from said fluidized bed to said loading/filtering segment.

20. A toner transport system as defined in claim 13, further including n said toner transport systems operatively connected in tandem and each delivering a different color toner to a single image receiver.

21. A process of toner transport in an electrostatic powder printing apparatus including the following steps:

loading toner onto a segmented traveling electrostatic wave toner conveyor including a loading/filtering segment and a delivery segment;

extracting wrong-sign toner from said conveyor;

moving said toner on a synchronous traveling electrostatic wave on said loading/filtering segment to said delivery segment;

moving said toner on an asynchronous traveling electrostatic wave on said delivery segment to an image receiving member; and extracting unused right-sign toner from said conveyor.

* * * * *